US006247830B1

(12) United States Patent
Winnett et al.

(10) Patent No.: US 6,247,830 B1
(45) Date of Patent: Jun. 19, 2001

(54) HEAT SHIELD FOR AGRICULTURAL LIGHT BULB

(76) Inventors: Russell Winnett; Michael Fanelli, both of Custom Automated Products Inc., P.O. Box 1540, Arizona City, AZ (US) 85223

( * ) Notice: Subject to any disclaimer, the term of this patent is extended or adjusted under 35 U.S.C. 154(b) by 0 days.

(21) Appl. No.: 09/344,808

(22) Filed: Jun. 25, 1999

Related U.S. Application Data

(60) Provisional application No. 60/094,560, filed on Jul. 29, 1998.

(51) Int. Cl.[7] ..... F21V 29/02

(52) U.S. Cl. ..... 362/264; 313/11; 313/13; 362/294

(58) Field of Search ..... 362/263, 264, 362/265, 294, 373; 313/11, 12, 13

(56) References Cited

U.S. PATENT DOCUMENTS

| | | | | |
|---|---|---|---|---|
| 2,155,279 | * | 4/1939 | McMahan | 362/264 X |
| 4,546,420 | | 10/1985 | Wheeler et al. | 362/268 |
| 4,651,048 | | 3/1987 | Liebe | 313/25 |
| 4,734,835 | * | 3/1988 | Vines et al. | 362/264 |
| 4,870,317 | | 9/1989 | Dannert et al. | 313/25 |
| 5,111,367 | * | 5/1992 | Churchill | 362/264 |
| 5,172,975 | | 12/1992 | Parker | 362/373 |
| 5,489,813 | | 2/1996 | Jung | 313/25 |
| 5,536,998 | | 7/1996 | Sica | 313/489 |
| 5,576,592 | | 11/1996 | Koenigsberg et al. | 313/25 |
| 5,612,585 | | 3/1997 | Verschueren | 313/44 |
| 5,621,267 | | 4/1997 | Shaffner et al. | 313/113 |
| 5,702,179 | * | 12/1997 | Sidwell | 362/265 X |

FOREIGN PATENT DOCUMENTS

| | | |
|---|---|---|
| S 41624 | 9/1956 | (DE) . |
| 721585 | 1/1955 | (GB) . |
| 2 227 827 | 8/1990 | (GB) . |
| 189 557 | 5/1964 | (SE) . |

* cited by examiner

*Primary Examiner*—Laura K. Tso
(74) *Attorney, Agent, or Firm*—Richard C. Litman

(57) ABSTRACT

An air-cooled light comprising a cylindrical transparent sleeve that shields heat generated by a high intensity discharge lamp from the surrounding environment. The air-cooled light of the present invention comprises an outer cylindrical transparent sleeve that surrounds a high-intensity discharge lamp. Sealingly attached to opposing ends of the transparent cylinder are two end plates for supporting the transparent cylinder from a ceiling structure. O-rings positioned between the end plates and the cylindrical transparent sleeve provides a seal for insulating the interior of the transparent cylinder from the external environment. The high-intensity discharge lamp is supported inside the transparent sleeve by a bracket attached to one of the end plates. Mounted on the interior surface of the transparent sleeve is a thermal protector that disconnects electrical power to the high intensity discharge lamp when the temperature inside the transparent sleeve reaches or exceeds a predetermined maximum safe operating temperature.

18 Claims, 3 Drawing Sheets

HEAT SHIELD FOR AGRICULTURAL LIGHT BULB

CROSS-REFERENCE TO RELATED APPLICATION

This application claims the benefit of U.S. Provisional Patent Application Serial No. 60/094,560, filed Jul. 29, 1998.

BACKGROUND OF THE INVENTION

1. Field of the Invention

The present invention relates generally to a heat shield for agricultural light bulbs and more particularly, to an air-cooled light fixture having a transparent cylinder that surrounds a high intensity discharge lamp for providing a continuous air path for removal of heat from the fixture.

2. Description of Related Art

High intensity light sources, such as agricultural bulbs, sealed beam lamps and the like, include optical devices which direct the light therefrom along a narrow beam path. These lamps get exceptionally hot when confined to a small area. It is important to operate these lamps at or as near as possible to their recommended operating temperatures. Higher than optimum temperature operation reduces their life span and lower temperatures prevent inert gas contained in many such lamps from returning tungsten from the bulb wall to the filament coils which blackens the lamp walls causing a reduced intensity output.

Several air-cooled light fixture designs in common use have sheet metal enclosures used in combination with borosilicate glass for providing a heat shield to insulate outside surroundings from heat generated by these light fixtures. However, the sheet metal enclosures typically get very hot during operation and radiate substantial heat to the surroundings. Additionally, several of these light fixture designs have channels formed inside the light fixtures that have nonlinear contours, thereby producing increased mechanical losses from airflow through the light fixtures and thereby reducing air-flow capacity associated with the channels. For example, U.S. Pat. No. 4,546,420, issued Oct. 8, 1985 to Wheeler et al. discloses an air-cooled light fixture having an air channel defined by several structural members projecting inwardly to form a jagged-shaped air-path. Such jagged air-paths impair the capacity of an air channel to cool the light fixture by restricting an air flow path. Similarly, German patent number S 41624 discloses an air-cooled light fixture having an enclosure surrounding a lamp with a channel formed in the enclosure for passing air through the light fixture. However, German patent number S 41624 does not disclose the light fixture having a straight and continuous channel for air flow. Consequently, heat removal by an air-cooling means cannot occur at a maximum flow rate. Great Britain patent number 721,585 discloses an air-cooled light fixture having a glass enclosure surrounding a fluorescent tube, wherein connected to a side wall of the enclosure are two conduits serving as an inlet and a outlet for passing air flow inside the light fixture. However, Great Britain patent number 721,585 does not disclose a light fixture having a straight and continuous air-channel configuration permitting maximum flow of air through the light fixture.

Several patents disclose a light fixture having a glass cylinder surrounding a light. For example, U.S. Pat. No. 5,489,813, issued Feb. 6, 1996 to Jung discloses a neon lamp including a transparent outer tube for preventing water from entering the lamp. However, U.S. Pat. No. 5,489,813 does not disclose a means for air cooling the lamp. U.S. Pat. No. 5,612,585 discloses a high-pressure discharge lamp including an outer envelope surrounding a discharge tube and a heat shield. However, U.S. Pat. No. 5,612,585 does not disclose the outer envelop as a heat shield.

A shortcoming of some common air-cooled light fixtures is their inability to sense the temperature of a light fixture and terminate electrical power to that light fixture when its temperature exceeds a predetermined maximum safe operating temperature. Another shortcoming of some air-cooled light fixtures is their lack of adaptability for being connectable to exhaust systems having varying air-flow capacities. Still another shortcoming of some common air-cooled light fixtures is an absence of waterproofing for protecting the light fixture from water damage. Yet still another shortcoming of some air-cooled light fixtures is an inability to be connected to outside sources of ventilation air.

None of the above inventions and patents, taken either singly or in combination, is seen to describe the instant invention as claimed, nor fulfill the needs or problems as set forth above. Thus an improved air-cooled light fixture is desired.

SUMMARY OF THE INVENTION

Accordingly, it is a principal object of the invention to provide an air-cooled light fixture having a straight and continuous air channel passing therethrough for allowing outside air to be easily passed through the light fixture for maximum heat removal.

It is another object of the invention to provide an air-cooled light fixture that is adapted to being connected to exhaust systems having varying air-flow capacities.

It is a further object of the invention to provide an air-cooled light fixture that is water-proof for providing water protection for internal electrical components against water damage.

Still another object of the invention is to provide an air-cooled light fixture having a thermal protector for disconnecting electrical power to the light fixture when temperature inside the light fixture exceeds a predetermined maximum safe operating temperature.

It is yet another object of the invention to provide an air-cooled light fixture capable of being attached to an outside source of ventilation air.

It is an object of the invention to provide improved elements and arrangements thereof in an apparatus for the purposes described which is inexpensive, dependable and fully effective in accomplishing its intended purposes.

In accordance with these and other objectives, the present invention is an air-cooled light fixture having a transparent cylinder that surrounds a high intensity discharge lamp for insulating heat generated by the high intensity discharge lamp from outside surroundings. In a preferred embodiment, the transparent cylinder is made of a borosilicate glass, for example, PYREX or KIMAX. Sealingly attached to opposing ends of the transparent cylinder are two end plates for supporting the light fixture from a ceiling structure. The high intensity discharge lamp is supported inside the transparent cylinder by fixedly attaching one end of the high intensity discharge lamp to one of the two end plates. Attached to one end of each of the two end plates is a hose flange for providing a means for connecting a hose to each end plate. Mounted to an inside wall of the transparent cylinder is a thermal protector device for disconnecting electrical power to the high intensity discharge lamp when a temperature inside the transparent cylinder reaches a predetermined temperature limit.

A circular curtain of air is pushed or pulled through the cylindrical transparent sleeve by blowers or fans. The rapidly moving flow of air continuously removes the heat generated by the high intensity discharge lamp. The ends of the transparent cylinder are connected to an exhaust hose and the exhaust hose is connected to fans or an exhaust vent that removes heat from the lamp fixture. The transparent cylinder not only functions as a heat shield but also serves as a safety barrier between the lamp and the outside environment should the lamp explode, whereby the glass from the lamp is retained within the fixture by the cylindrical transparent sleeve of the present invention. A reflective hood is used to reflect light emanating from the top surface of the lamp downwards towards the ground.

Although, in the preferred embodiment of the present invention the transparent cylindrical sleeve is made of a borosilicate glass, the transparent cylindrical sleeve could be made from any suitable transparent material, for example, a plastic. Therefore, any material that is transparent and capable of withstanding high temperatures could be used. Additionally, although the preferred embodiment of the present invention is directed towards a transparent sleeve having a cylindrical shape, the transparent sleeve could have various other shapes such as square, rectangular, hexagonal, octagonal, and the like.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
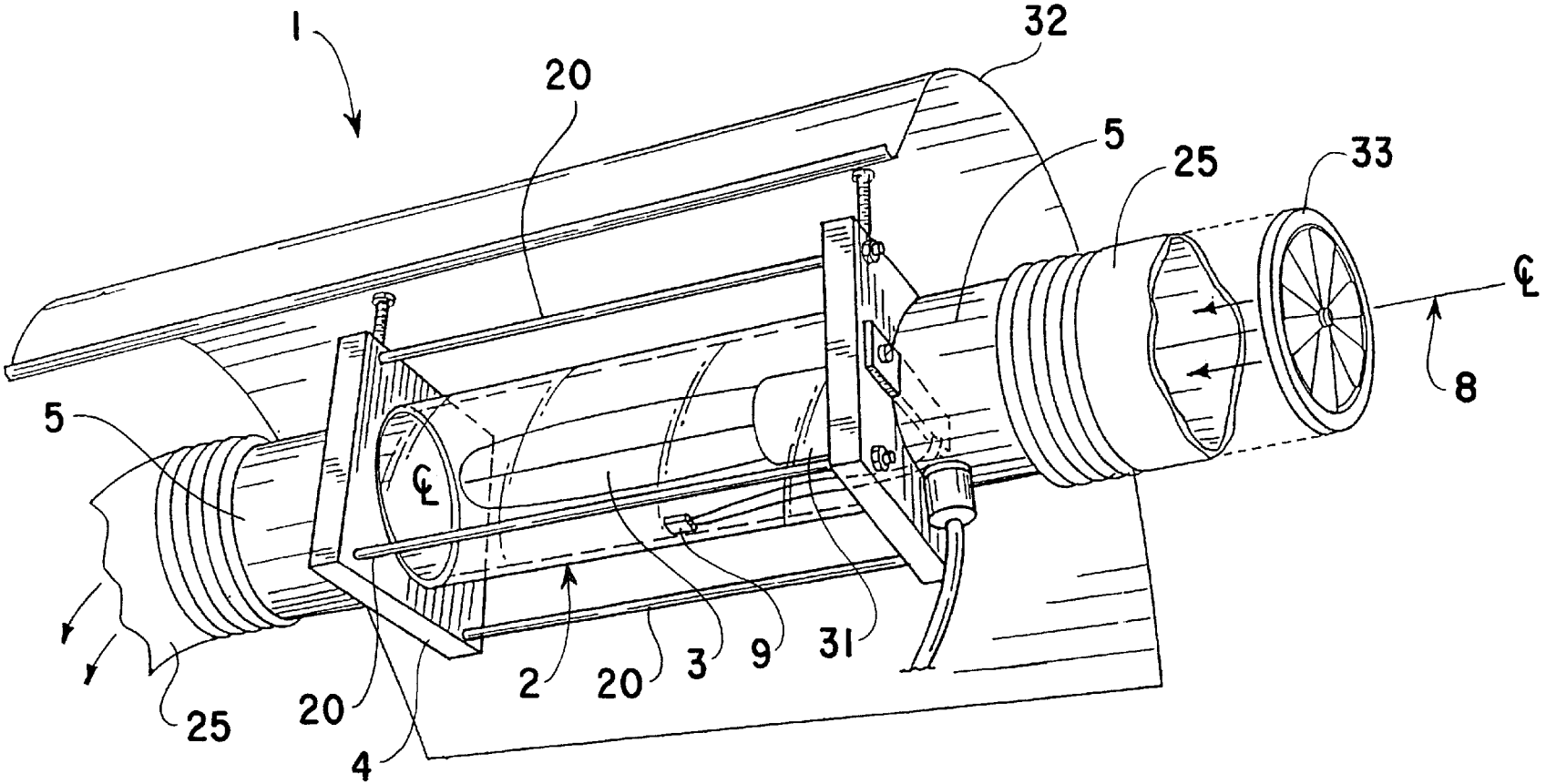
FIG. 1 is an environmental, perspective view of a heat shield for agricultural light bulbs according to the present invention.

The present invention is an air-cooled light fixture for shielding an agricultural or HID (high intensity discharge) light bulb. The invention can best be appreciated by referring to FIG. 1 which shows a perspective view of the air-cooled light fixture 1 of the present invention. The air-cooled light fixture 1 comprises a glass cylinder 2 that surrounds a high intensity discharge lamp 3 mounted in a socket 31. The cylindrical glass sleeve 2 insulates the high intensity discharge lamp 3 from outside surroundings or environment. The light fixture 1 further comprises a thermal protector 9 placed inside the glass cylinder 2 for selectively disconnecting electrical power supplied to the high intensity discharge lamp 3 when a temperature inside the glass cylinder 2 meets or exceeds a predetermined maximum safe operating temperature. The air-cooled light fixture further comprises two end plates 4 attached to the glass cylinder 2 at opposing ends of the glass cylinder 2 for supporting the light fixture from a ceiling structure or the like. Passing through each of the two end plates 4 are four bolts 20 for holding the end plates 4 against the glass cylinder 2. Lastly, the air-cooled light fixture further comprises two hose flanges 5, each of which is attached to one end of plates 4 for connecting a hose 25 to the light fixture for air cooling purposes. A reflective hood 32 disposed above the lamp 3 reflects light from the lamp 3 downwards towards the ground.

Figure 2:
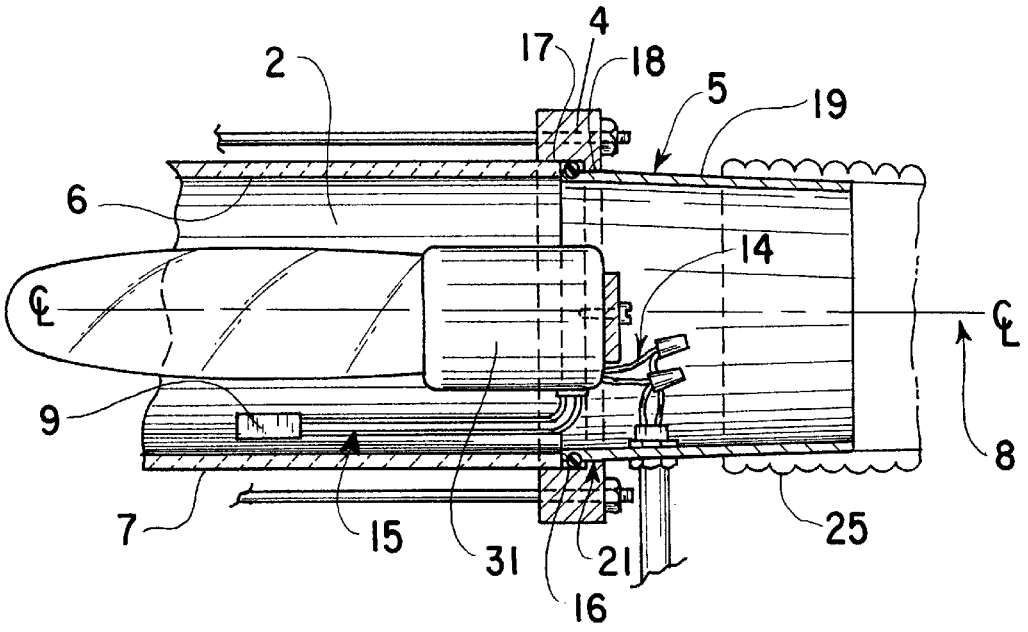
FIG. 2 is a partial, sectional view of the heat shield according to the present invention.
Figure 3:
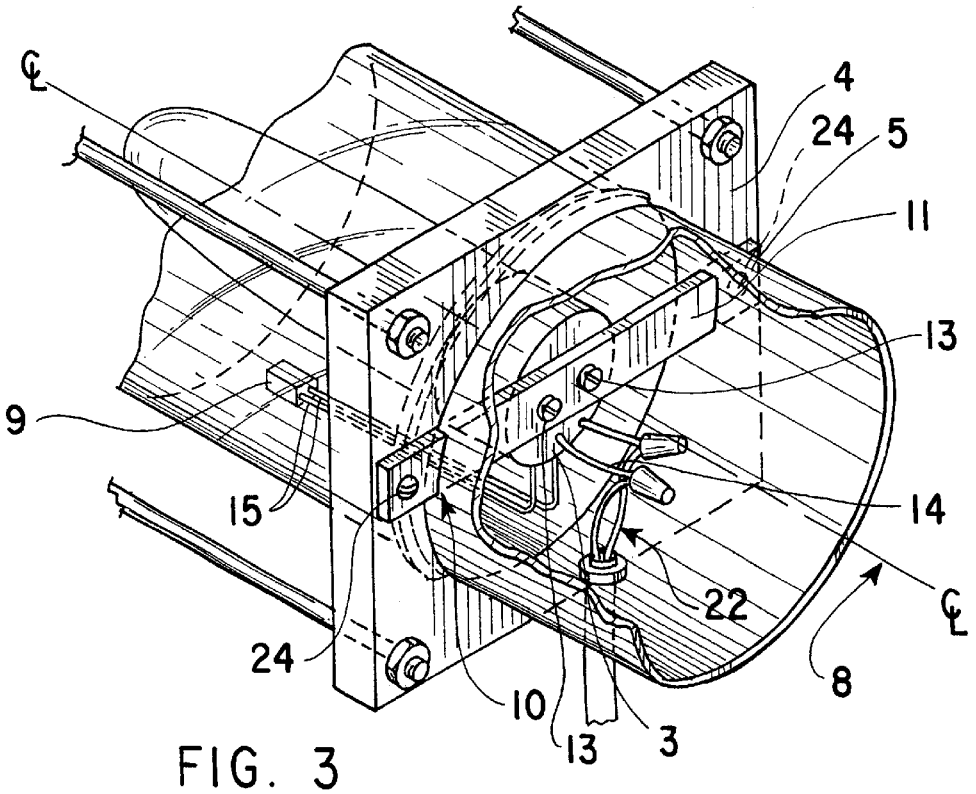
FIG. 3 is a partially fragmented perspective view of the heat shield according to the present invention.

Further details relating to the structure of the air-cooled light fixture 1 are shown in FIGS. 2 and 3. FIG. 2 shows the glass cylinder 2 defined by a tubular glass wall having an inner surface 6 and an outer surface 7. The inner surface 6 and the outer surface 7 are concentric about a central axis 8 (centerline CL) extending in a direction lying parallel to the length of the glass cylinder 2. It will be revealed that the central axis 8 is used as a point of reference for supporting the high-intensity discharge lamp 3 inside the glass cylinder 2. Preferably, a gap of approximately 1 to 1½ inches exists between the high intensity light fixture and the glass cylinder for insulating an area surrounding the high intensity light fixture from heat generated by the high intensity light fixture. This air gap insulates the large amount of heat generated at the lamp's surface, thereby reducing the amount of heat radiating outward which lowers the external temperature of the lamp. The lower external lamp temperature allows the air-cooled lights to be positioned closer to the plants to increase light intensity without the risk of burning the plants. Since the air-cooled lights of the present invention can be placed closer to the plants, smaller wattage lamps can be used which result in a reduction in power consumption.

According to a preferred embodiment of the invention, the glass cylinder 2 is constructed of PYREX glass. Preferably, the PYREX glass is constructed from borosilicate glass to improve removal of heat from the high intensity light fixture. A blower or fan 33, such as a squirrel cage blower fan or an in-line axial fan, can be used to move air through the cylindrical glass sleeve 2. As depicted in FIG. 1 by parallel arrows, air flows straight through the glass cylinder 2, preferably in a circular pattern.

As best shown by FIG. 2, each of the two end plates 4 is further defined by a first inner diameter surface 17 and a second inner diameter surface 18 forming an indented portion 21 for properly positioning a hose flange 5 against one of the end plates 4. The two end plates 4 are preferably made of a polycarbonate material. Positioned around an outer surface 19 of each hose flange 5 between the glass cylinder 2 and each one of the end plates 4 is an O-ring 16 for providing a water-proof seal between the glass cylinder 2 and each one of the end plates 4.

Support of the high intensity discharge lamp 3 is best appreciated by referring to FIG. 3. Cut away and removed from each one of the two hose flanges 5 are rectangular slots 10 located on each of two diametrically opposite sides of the hose flange 5 for receiving a bracket 11 preferably constructed from aluminum therebetween, and for supporting the high intensity discharge lamp 3. The aluminum bracket 11 is passed through the rectangular slots of hose flange 5 and affixed to one side of each end plates 4. According to a preferred embodiment of the invention, a pair of screws 24 are passed through the aluminum bracket 11 and threadedly affixed to the end plate 4, thereby fixedly supporting the aluminum bracket 11. The high intensity discharge lamp 3 is fixedly attached to the aluminum bracket 11 by a pair of conventional screws 13. The high intensity discharge lamp 3 is preferably attached to the aluminum bracket 11 such that the entire length of the high intensity discharge lamp 3 is centered about the central axis (CL) 8 as previously described.

Next, a means for operating and controlling the high intensity discharge lamp 3 is described. As shown in FIGS. 2 and 3, the high intensity discharge lamp 3 has a first pair of wires 14 and a second pair of wires 15 attached thereto. Both the first pair of wires 14 and the second pair of wires 15 are conventional wires commonly used in conventional high-intensity discharge lamps. The first pair of wires are electrically attached to conventional AC wiring 22 for providing electrical power to the high intensity discharge lamp 3. The second pair of wires 15 are electrically connected to the thermal protector 9 for serving as a switch to electrically disconnect electrical power supplied to the high intensity discharge lamp 3 when a temperature inside the air-cooled light fixture 1 exceeds a predetermined maximum safe operating temperature. The thermal protector 9 is mounted to the inner surface 6 of the glass cylinder 2 for keeping the thermal protector 9 from restricting the air path inside the glass cylinder 2.

Figure 4:
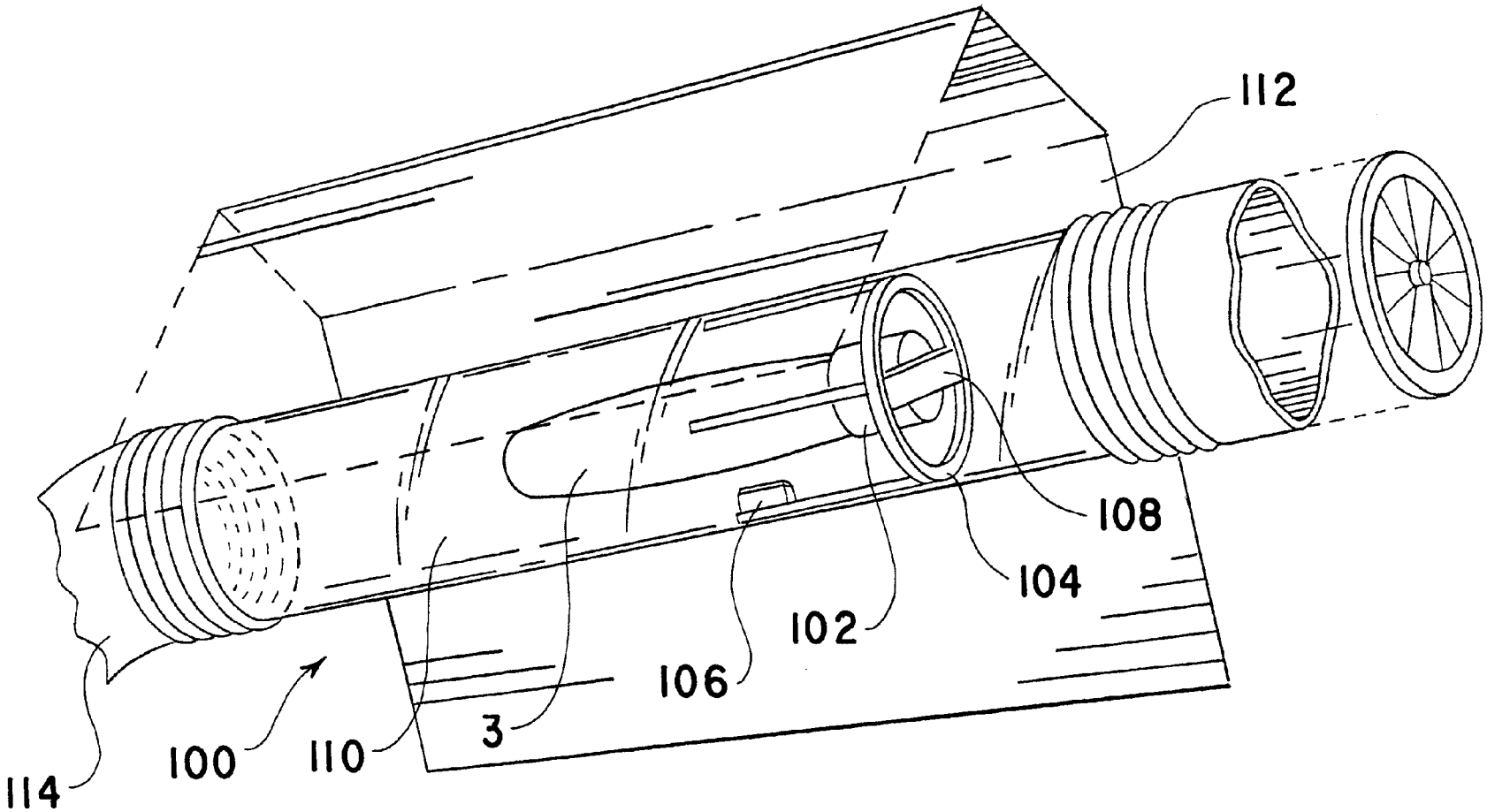
FIG. 4 is an environmental, perspective view of a preferred embodiment of the heat shield for agricultural light bulbs according to the present invention.

FIG. 4 is an environmental, perspective view of a preferred embodiment of the heat shield 100 for agricultural light bulbs of the present invention. In the preferred embodiment, the internal socket/thermal switch assembly (102,104,106,108) of the present invention has no end cap, therefore, there is a reduction in manufacturing costs. A thin spring type material is used to fabricate the frame 104 of the holder assembly (104,108) with the holder assembly (104, 108) sliding inside the cylindrical glass sleeve 110. The socket 102, the socket support strip 108, and the thermal switch 106 are mounted on the frame 104 of the holder assembly (104,108) having a pronged configuration. The socket support strip 108 can be made of either the same material as that of the frame 104 or a different material than that of the frame 104, for example, the socket support strip 108 could be made of a metal and the frame 104 made of a plastic. The cylindrical glass sleeve 110 is preferably made of KIMAX glass.

The air duct or hose 114 is fastened directly to the outside of the cylindrical glass sleeve 110 with clamps (not shown) maintaining the integrity of the water-tight seal. Any suitable clamping means can be used. The cylindrical glass sleeve 110 passes through a reflective hood 112 that provides the method of hanging the unit above the ground. The holder assembly (104,108) can be made of plastic and formed by injection molding. The holder assembly (104,108) can be configured to any desired shape, for example, instead of the pronged configuration depicted in FIG. 4, the holder assembly could have a one piece cylindrical configuration (not shown). Electrical power is supplied to the high intensity discharge lamp 3 via conventional AC wiring 22 as depicted in FIG. 3.

The air-cooled light of the present invention reflects a straight flow through design that eliminates leakage, reduces exposed surface area, and maximizes both air circulation velocity and heat removal. By varying the diameter of the cylindrical glass sleeve, high intensity discharge lamps of different wattage can be accommodated. Internal baffles and/or vortex inducers can be added to improve the efficiency of heat removal. The air-cooled light of the present invention can be used within an enclosed growing area using carbon dioxide, because the internal components of the air-cooled light are completely sealed, thereby enabling the air-cooled light to circulate air from outside the enclosed growing area, through the lamp fixture, then returned back outside the closed growing area, while removing heat from the light, without removing carbon dioxide from the enclosed growing area.

The water proof O-ring seal feature of the present air-cooled light permits the fixture to be easily and safely washed without adversely affecting the proper functioning of the light. The thermal protector feature is applicable to various situations wherein a bulb or lamp housed inside a glass enclosure must be protected from overheating.

The preferred embodiments of the present invention disclosed herein are intended to be illustrative only and are not intended to limit the scope of the invention. It should be understood by those skilled in the art that various modifications and adaptations of the present invention as well as alternative embodiments of the present invention may be contemplated. For example, the end plates could be made in several shapes including round, square, or hexagonal. It is to be understood that the present invention is not limited to the sole embodiment described above, but encompasses any and all embodiments within the scope of the following claims.

We claim:

1. An air-cooled light comprising:

a high intensity discharge light bulb secured in a socket;

a cylindrical transparent sleeve surrounding said high intensity discharge light bulb and said socket, said cylindrical transparent sleeve having opposing ends;

two sealed end plates, each being attached to one of the opposing ends of said cylindrical transparent sleeve, said socket being attached to one of the two sealed end plates;

a first hose flange having one end attached to one of said sealed end plates and an opposing inlet end;

a second hose flange having one end attached to the other of said sealed end plate and an opposing outlet end;

a hose circumferentially attached to the inlet end of said first hose flange and the outlet end of said second hose flange, thereby forming a closed path for moving air through said cylindrical transparent sleeve; and a temperature actuated disconnect switch disposed within said cylindrical transparent sleeve, said disconnect switch adapted to disconnect an electrical power source from said high intensity discharge light bulb when temperature inside of said cylindrical transparent sleeve reaches or exceeds a predetermined temperature.

2. The air-cooled light according to claim 1, wherein:

said cylindrical transparent sleeve is made of borosilicate glass.

3. The air-cooled light according to claim 1, wherein:

a gap exists between said high intensity discharge light bulb and said cylindrical transparent sleeve which serves to insulate an area surrounding said high intensity discharge light bulb from heat generated by said high intensity discharge light bulb.

4. The air-cooled light according to claim 1, wherein:

said two end plates are made of a polycarbonate material.

5. The air-cooled light according to claim 1, wherein:

two O-rings are separately sandwiched between said cylindrical transparent sleeve and said two end plates at said opposing ends of said cylindrical transparent sleeve thereby creating a water-proof seal between said cylindrical transparent sleeve and said two end plates.

6. The air-cooled light according to claim 1, wherein:

one of said two hose flanges has two rectangular slots formed in opposing sides therein which allows a bracket to pass through said one of said two hose flanges.

7. The air-cooled light according to claim 6, wherein:

one of said two end plates has an aluminum bracket that is fixed in a specific position.

8. The air-cooled light according to claim 7, wherein:

said aluminum bracket is also attached to said socket and supports said socket in a fixed position.

9. The air-cooled light according to claim 1, wherein:

each of said two end plates has an indented portion for properly positioning one of said two hose flanges against one of said two end plates.

10. The method of cooling a high intensity discharge light comprising:

passing high velocity air into one end of a cylindrical transparent sleeve that houses a high intensity discharge light bulb and removing the high velocity air from the opposite end of the cylindrical transparent sleeve; and disconnecting the high intensity discharge light bulb from an electrical power source if a temperature inside of said cylindrical transparent sleeve exceeds a predetermined temperature.

11. The method of cooling a high intensity discharge light according to claim 10, wherein:

the high velocity air flows in a circular pattern.

12. The method of cooling a high intensity discharge light according to claim 11, wherein:

the high velocity air is generated by a fan.

13. An air-cooled light comprising:

a high intensity discharge light bulb mounted in a socket assembly wherein said socket assembly is made of a spring type material;

a cylindrical transparent sleeve having opposing ends surrounds said high intensity discharge light bulb and said socket assembly;

two hoses form a conduit for transporting air through said cylindrical transparent sleeve, wherein one of said two hoses is circumferentially attached to one end of said cylindrical transparent sleeve while the other of said two hoses is circumferentially attached to the opposite end of said cylindrical transparent sleeve, thereby forming a closed path for moving air through said cylindrical transparent sleeve; and a thermal protector mounted on said socket assembly that disconnects an electrical power source from said high intensity discharge light bulb when a temperature inside of said cylindrical glass sleeve reaches or exceeds a predetermined temperature.

14. An air-cooled light according to claim 13, wherein:

said socket assembly is made of plastic.

15. An air-cooled light according to claim 14, wherein:

said socket assembly is formed by injection molding.

16. An air-cooled light according to claim 13, wherein:

said cylindrical transparent sleeve is made of KIMAX glass.

17. An air-cooled light according to claim 1, wherein:

said cylindrical transparent sleeve is made of a plastic.

18. An air-cooled light according to claim 13, wherein:

said cylindrical transparent sleeve is made of a plastic.

* * * * *